United States Patent [19]

Longoni

[11] Patent Number: 4,856,808

[45] Date of Patent: Aug. 15, 1989

[54] BINDING DEVICE FOR SNOW BOARDS

[76] Inventor: Andrea Longoni, Via Leoni, 9 - Como, Italy

[21] Appl. No.: 126,503

[22] Filed: Nov. 30, 1987

[30] Foreign Application Priority Data

Dec. 3, 1986 [IT] Italy ..... 7211 A/86

[51] Int. Cl.[4] ..... A63C 9/08

[52] U.S. Cl. ..... 280/617

[58] Field of Search ..... 280/607, 611, 616, 617, 280/618, 619, 620, 628, 633, 636, 12 H; 441/70

[56] References Cited

U.S. PATENT DOCUMENTS

| | | | |
|---|---|---|---|
| 1,541,019 | 6/1925 | Yongman | 280/619 |
| 3,838,866 | 10/1974 | b'Allessio et al. | 280/607 |
| 3,900,204 | 8/1975 | Weber | 280/607 |
| 4,647,062 | 3/1987 | McDougall | 280/607 |
| 4,652,007 | 3/1987 | Dennis | 280/12 H |

FOREIGN PATENT DOCUMENTS

| | | | |
|---|---|---|---|
| 0604766 | 9/1978 | Switzerland | 280/607 |

*Primary Examiner*—Charles A. Marmor
*Assistant Examiner*—Richard Camby
*Attorney, Agent, or Firm*—Robbins & Laramie

[57] ABSTRACT

The binding device for snow boards comprises a base plate (2) directly integral with the snow board (26) supporting, hinged along the same axis (18), a toe plate (3) and a heel plate (4). Both the heel plate (4) and the toe plate (3), whose positions relatively to the base plate (2) are adjustable, are equipped with straps (5, 6) for gripping a snow boot.

26 Claims, 2 Drawing Sheets

BINDING DEVICE FOR SNOW BOARDS

The present invention is concerned with a binding device for snow boards, comprising first plate means integral with the snow board, supporting second plate means made integral with the snow boot be means of strap means.

The use is recent of one single ski to slide down the snow-covered slopes instead of the traditional pair of skis used from time immemorial. The manoeuvres which the user must make a snow board carry out are substantially identical to those carried out by a couple of skis sliding in coupled position.

But the movements the skier must carry out to drive a snow board are different from those which the same skier must carry out when driving a couple of skis, due to the monolithic character of the snow board, even if in both cases the necessary movements can all be reconducted to a shifting of the barycentre of the skier relatively to the equipment.

In such a situation, the binding devices interposed between the skier and the same equipment play a very important role, because they must be capable of allowing the skier barycentre to suitably move relatively to the snow board, but preventing the lower limbs from being constrained in abnormal and/or dangerous positions, with a consequence over-stressing of the articulations of the same limbs.

Up to date, this problem has not yet been satisfactorily solved by the present binding devices, which substantially are of two types: the soft-structure binding devices, and the right-structure binding devices.

The soft-structure binding devices comprise an overboot of a flexible plastics material constrained in the snow board and suitable for containing traditional apres-ski boots. The fastening of the apres-ski boots relatively to the overboot is carried out by means of hooks (with which the same overboot is equipped), which are adjustable in closure position, such to reconcile the dimensions of the apres-ski boot with the desired value for the gripping force.

The structural flexibility of such binding devices makes it possible, in particular for, the skier's ankle to be free in its articulation, but with the disadvantage of a lesser amount of protection of said ankle in case of a fall.

Furthermore, the muscles governing the ankle articulation are charged with most of the working load useful for carrying out the shiftings necessary for driving the snow board, with consequent rapid fatiguing thereof.

On the contrary, the flexibility of the binding device, together with the used boot, makes it anyway possible to easily reach the natural opened-wide-apart position of the lower skier's limbs, such that the skier's knees may operate under optimum conditions.

As a consequence of the above, such types of binding devices are only preferable for a driving conduct on soft snow, which prefers precision to speed.

The rigid-structure binding devices comprise, on the contrary, a couple of plates joined to each other.

A first plate of said couple of plates is integral with the snow board, and a second plate of said couple of plates is interposed, in an adjustable position, between said first plate, and a downhill-ski boot. The second plate is hence equipped with strap-shaped metal elements, which engage, in their gripping position, the corresponding hollows traditionally provided on the common downhill-ski boots.

Such binding devices, by being provided with a rigid bond, do not allow any movements to occur of the two plates relatively to each other, and hence of the ski boot sole and the ski board.

As a consequence of the above, in as much as also the downhill-ski boot is rigid, the best conditions occur for the work of the skier's ankle, above all at high speeds, with the maximum protection of the same ankle in case of a falling.

The articulation of the skier's knee are however required to compensate for the missed flexion of the ankle, imposed by the divergent position of the skier's limbs. Hence, both on the articulations of the skier's knee, and on the strap-shaped metal elements, abnormal stresses take place. In particular, the strap-shaped metal elements undergo frequent breakages due to the stresses induced in them by unavoidable attempts of rotation of the ski boot relative to the second plates.

The purpose of the present invention is to provide a binding device for snow boards capable of obviating all of the above drawbacks, such to allow the skier's lower limbs to assume an absolutely ergonomic and safe driving position, so to enable the skier to display a precise, and at the same time, fast, driving conduct.

Such purposes are achieved by a binding device for snow boards comprising first plate means integral with the snow board, supporting second plate means made integral with the snow boot by means of strap means, characterized in that said first plate means and said second plate means are linked with each other, with the possibility of moving relatively to each other.

The invention is illustrated, for purely exemplifying, and not limitative, purposes, in the figures on the hereto attached drawing tables, wherein.

Figure 1:
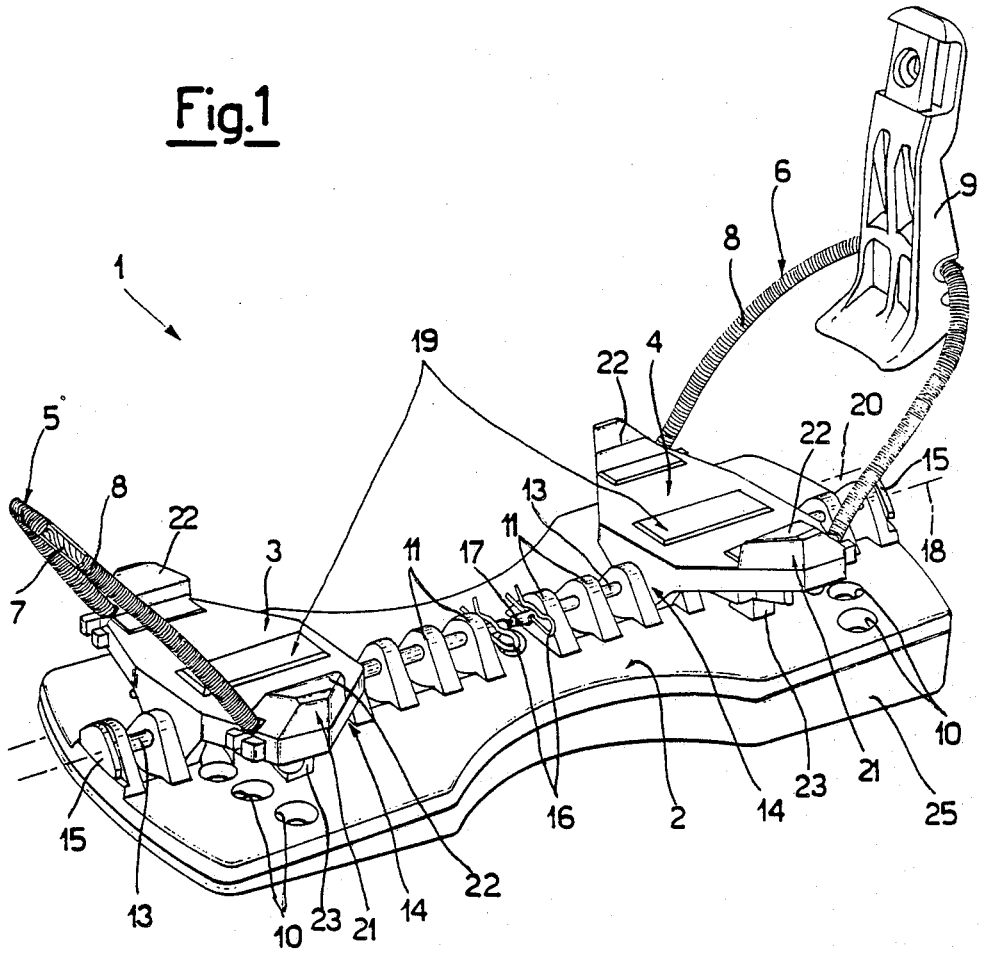
FIG. 1 shows a perspective view of a binding device according to the present invention associated with a wedge element.

Referring to the above mentioned Figures, the binding device of the invention, generally indicated by the reference numeral 1, substantially comprises first plate means integral with the snow board, supporting second plate means bound to the snow boot, by means of strap means.

The first plate means are constituted by a single base plate 2, provided with a set of through bores 10 (for it to be adjustably bound), whilst the second plate means are constituted by a toe plates 3 and a heel plate 4 bound to the base plate by means of hinge means.

The strap means with which the toe plate 3 and the heel plate 4 are provided, are constituted by a couple of metal straps, a first strap 5 and a second strap 6, respectively fastened at their ends to the toe plate 3 and the heel plate 4.

Both said metal straps 5 and 6 are formed by a metal cable 7 contained inside a spiral metal sheath 8.

The second strap 6 supports, on its middle, a lever cam 9 which presses, in its locking position, a suitable hollow provided in the snow boot (in this particular case, constituted by a downhill-ski boot, not shown in the Figures).

The hinge means interposed between the base plate 2 and the toe plate 3 and the heel plate 4 comprise a couple of hinges 14, the one of said couple of hinge means being positioned between the base plate 2 and the toe plate 3, and the other being positioned between the base plate 2 and the heel plate 4. Each hinge 14 comprises a first set of flanges 11 integral with the base plate 2 and a second pair of flanges 12 integral with the toe plate 3 or with the heel plate 4, according to the hinge 14 taken into consideration.

The number of flanges 11 is larger than the number of the flanges 12, such as to make it possible to change, as desired, the position of the toe plate 3 and of the heel plate 4 relatively to themselves, and to the base plate 2.

Both the flanges 11 and the flanges 12 are perforated at their top, so that through them a common pin 13 passes, whose axis 18 coincides with the axis of both hinges 14 around which the rotation of the plates 3 and 4 relatively to the plate 2 takes place.

The pin 13 comprises a stem, at whose first end there is a head 15, having a triangle shape, such to prevent the same pin 13 from rotating. At the second end of the stem of the pin 13, means are provided, to prevent the same pin from exiting its seat, which are constituted by a split pin 16 engaging a through bore 17 provided in the same pin 13.

The toe plate 3 and the heel plate 4 jointly define one single support surface 19 for the snow boot. The support surface 19 has a longer axis 20 which defines a vertical plane different from the vertical plane defined by the revolution axis 18 of the hinges 14 coincident with the axis of the pin 13.

In such way, the plates 3 and 4, in position of static load under the weight of the skier tend to naturally and automatically assume an inclined position relatively to the base plate 2.

Such position of the plates 3 and 4 enables the user of the snow board to easily maintain his dynamic equilibrium.

Both the toe plate 3 and the heel plate 4 comprise side retaining elements 21 for laterally holding the ski boot. Said side retaining elements 21 comprise upper invitation planes 22, which are oblique and convergent towards the longer axis 20 of the support surface 19.

Under the support surface 19, and, therefore, under the toe plate 3 and under the heel plate 4, elastic elements are provided, which cushion the rotation of the plates 3 and 4. The elastic elements are constituted by blocks 23 of such an elastic and yielding material as rubber, which are retained inside seats 24 positioned on the same side of the toe plate 3 and of the heel plate 4 which, relatively to the axis of rotation 18 of the hinge 14, has the lower range.

The binding device 1 is optionally completed by wedge-shaped means, constituted by a wedge 25, which can be interposed between the base plate 2 and a snow board 26.

Figure 4:
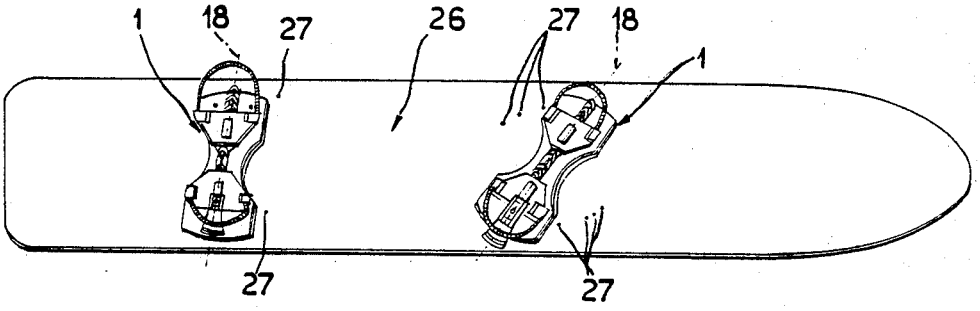
FIG. 4 shows an upper, perspective view of a pair of binding means according to the present invention mounted on a snow board.
Figure 2:
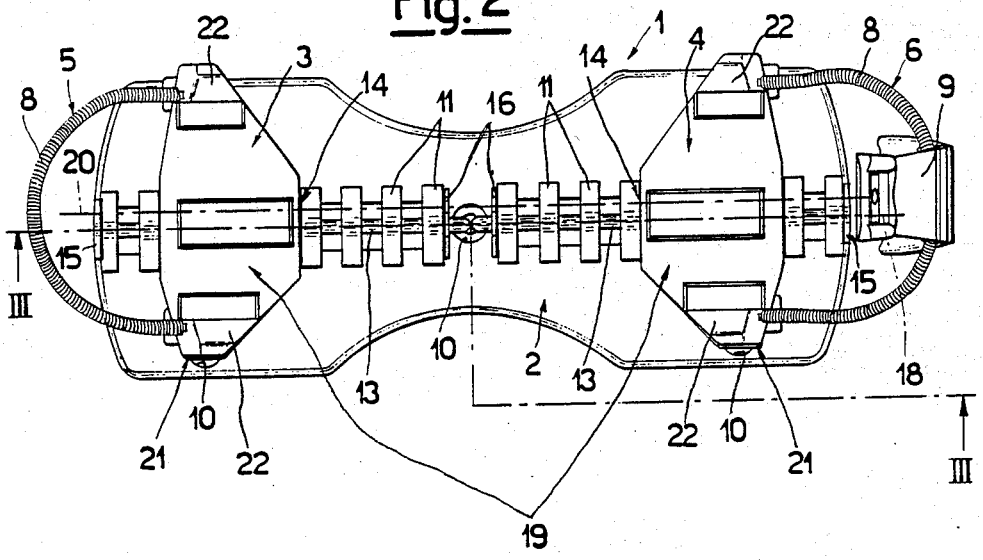
FIG. 2 shows a plan view of the device of FIG. 1.
Figure 3:
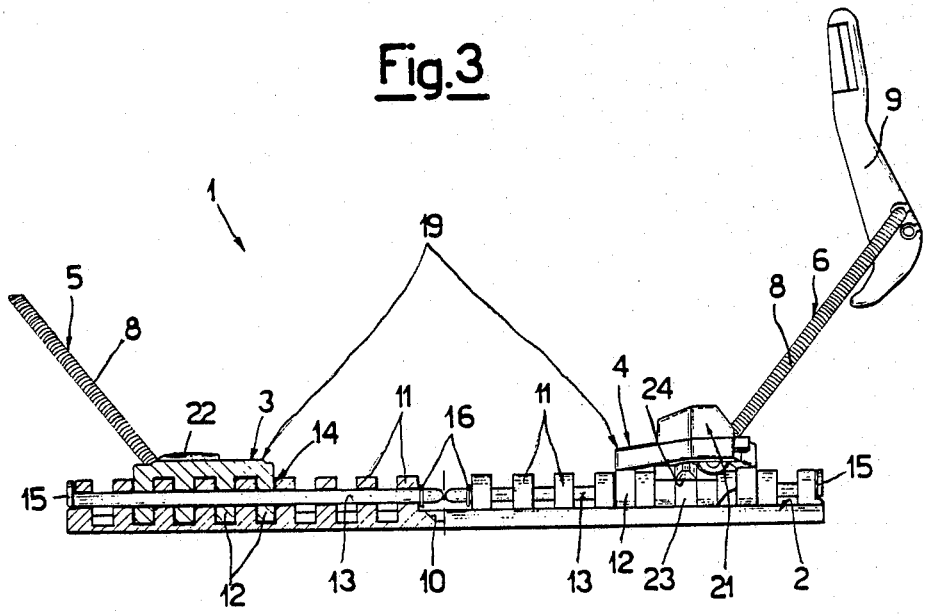
FIG. 3 shows a sectional view according to path III—III of FIG. 2.

Referring in particular to FIG. 4, the wedge 25 is associated with the binding device 1 which, between the two binding devices which are necessary to drive each snow board 26, is the one which is positioned more rearwards relatively to the tip of the same snow board, such to enable the user to reach his optimum driving position.

The two binding devices 1 are mounted on the snow board in such a way that their relevant axes 18 and 20 are incident in a point external to the snow board and with an angle which can be finely adjusted thanks to the plurality of combinations which can be realized due to the coincidence between the through bores 10 with screwthreaded blind bores 27 provided on the upper surface of the snow board 26.

The device of the invention, besides making it possible for the snow board to be perfectly driven both at high and at low speeds without excessively fatiguing the skier, who operates in a perfectly ergonomic position, offers further advantages:

(a) the operations for the adjustment in position of the plates are so simple that they enable the user to carry out them also on the sliding track, in as much as no use of any tools is necessary;

(b) the skier can discontinue using traditional skis, and directly start using a snow board, and vice-versa, with no need of replacing the type of snow boots he is wearing with another, purposely designed, type;

(c) the operations of snow board hiring are simplified, such a simplification deriving from the combination of the advantages as of above (a) and (b) points;

(d) it is possible to integrate both the heel plate and the toe plate with conventional safety binding devices as presently used on traditional skis, thus increasing the overall safety of the binding device of the invention;

(e) through the binding devices, smaller stresses are transmitted to the snow boards, thanks to the central position of the hinges 14 which bind the base plate 2 to the toe plate 3 and to the heel plate 4. The presence of the hinges 14, and their central position prevents in fact bending momentums from being transmitted to the base plate 2, with the consequent elimination of the danger of pulling of the screws which bind it to the snow board 26.

(f) the hinges 14 are given a particularly strong structure thanks to the presence of a plurality of flanges 11 and 12 alternating to and opposite to one another, which transmit to the pin 13, which passes through them, only shear stresses, furthermore distributed throughout the length of the same pin;

(g) also the first metal strap 5 and the second metal strap 6 undergo lower stresses, because any revolutionary impulses which can be generated between the ski boot sole and the underlying plates, with the overcharging of the straps 5 and 6, are absorbed by the hinge 14.

We claim:

1. A binding device having a pair of bindings for securing each foot of a user to a snow board, each binding comprising first plate means fixedly mountable to the snow board, second plate means generally overlying said first plate means and including means for releasably engaging a boot worn by a snow board user, a displaceably fixed pivot pin assembly formed integral with said first plate means, said pivot pin assembly comprising at least one fixedly mounted pivot pin that extends in a direction generally parallel to a longitudinal axis of said first plate means, said second plate means being supported by said pivot pin assembly and said first plate means and said second plate means being interconnected and pivotable relative to one another about said displaceably fixed, longitudinally-extending pivot pin assembly.

2. A binding device according to claim 1, wherein said pivot pin assembly comprises hinge means adapted to receive said at least one fixedly mounted pivot pin.

3. A binding device according to claim 1, wherein said first plate means comprises a single base plate and said second plate means comprises a toe plate and a heel plate each having a strap for engaging the boot of a snow board user.

4. A binding device according to claim 2, wherein said hinge means comprises first and second hinges, one of said hinges being interposed between the heel plate and the base plate, and the other of said hinges being interposed between the toe plate and the base plate.

5. A binding device according to claim 1, wherein a plurality of spaced apart mounting apertures is provided in said first plate means for mounting said binding device at a selective angle on the snow board.

6. A binding device according to claim 2, wherein said hinge means comprises a pair of mutually engageable hinge flanges, one of said hinge flanges of said flange pair being formed integral with said base plate, and the other of said hinge flanges of said hinge flange pair being formed integral with said second plate means.

7. A binding device according to claim 2, wherein said second plate means defines a support surface for the snow boot of a user, said support surface further including a second longitudinal axis defining a longitudinal centerline for said support surface displaced laterally from the longitudinal axis about which the first and second plate means are pivotable.

8. A binding device according to claim 2, wherein the second plate means are provided with a plurality of elastic elements for cushioning plate pivoting of the second plate means.

9. A binding device according to claim 8, wherein said elastic cushioning elements comprise blocks of an elastic, yielding material and are positioned between the first and second plate means.

10. A binding device according to claim 9, wherein said cushioning blocks are formed of rubber and are housed inside seats which are provided under the second plate means.

11. A binding device according to claim 10, wherein the cushioning blocks are all positioned on the same side of the longitudinal axis of the second plate means, with said side being the side showing the lowest range.

12. A binding device according to claim 3, wherein each of said boot-engaging straps comprises a metal cable coated by a metal spiral sheath.

13. A binding device according to claim 3, wherein both the toe plate and the heel plate comprise side retaining elements for laterally holding the boot of the user, each of said side retaining elements having an upper invitation plane which is oblique and converging towards the second plate means.

14. A binding device according to claim 1, further comprising wedge means positioned between the first plate means and the snow board.

15. A binding device according to claim 7, wherein each of the pair of bindings is mountable on the snow board such that the longitudinal axes of the bindings are convergent at a point external to the ski board.

16. A binding device according to claim 15, wherein the angle of convergence of the longitudinal axes of the two binding devices is adjustable.

17. A binding device according to claim 1, wherein said first and second plate means are pivotably movable relative to one another about said fixed longitudinal axis only.

18. A binding device according to claim 3, wherein said toe plate and said heel plate are hingedly and pivotably coupled to said first plate along a common axis.

19. A binding device according to claim 18, wherein said toe plate and said heel plate are hingedly and pivotably coupled to said first plate by hinge means comprising a plurality of intermeshable flanges extending generally transversely from said toe plate, heel plate and first plate means.

20. A binding device according to claim 3, wherein said toe plate and said heel plate are independently coupled to said plate means by corresponding axially-aligned hinge pins.

21. A binding device according to claim 2, further comprising means for inhibiting rotation of said hinge pin.

22. A binding device according to claim 1, further comprising cushioning means interposed between said first and second plate means.

23. A binding device according to claim 22, wherein said cushioning means inclines said second plate means relative to said first plate means.

24. A binding device according to claim 22, wherein said cushioning means are provided along one side only of said longitudinal pivot axis.

25. A binding device according to claim 6, wherein said hinge pin comprises a head formed at a first end thereof and a stem having a second pin end mountable within a pin seat, said second pin end having means for preventing said hinge pin from exiting its seat.

26. A binding device according to claim 26, wherein the pin head is configured so as to prevent any rotation of said pin relative to said hinge flanges, said pinexiting-preventing means comprising a split pin engaging a through-bore provided at the second end of said hinge pin.

* * * * *